US005220175A

United States Patent [19]

Cole

[11] Patent Number: 5,220,175

[45] Date of Patent: Jun. 15, 1993

[54] PORTABLE RADIATION PROTECTION ENCLOSURE DEVICE

[76] Inventor: Andrew J. Cole, 4805 Saint John's Dr., Highland Park, Tex. 75205-3143

[21] Appl. No.: 824,027

[22] Filed: Jan. 22, 1992

[51] Int. Cl.[5] ..... G21F 3/00

[52] U.S. Cl. ..... 250/515.1; 250/516.1; 250/519.1

[58] Field of Search ..... 250/515.1, 516.1, 517.1, 250/518.1, 519.1

[56] References Cited

U.S. PATENT DOCUMENTS

| | | | |
|---|---|---|---|
| 2,494,664 | 1/1950 | Lubow | 250/516.1 |
| 3,052,799 | 9/1962 | Hollands | 250/516.1 |
| 3,093,829 | 6/1983 | Maine | 250/516.1 |
| 4,417,146 | 11/1983 | Herbert | 250/516.1 |
| 4,616,668 | 10/1986 | Battiston | 135/75 |
| 4,924,103 | 5/1990 | Stein et al. | 250/516.1 |
| 4,965.456 | 10/1990 | Huettenrauch | 250/515.1 |
| 5,015,864 | 5/1991 | Maleki | 250/516.1 |

*Primary Examiner*—Jack I. Berman
*Assistant Examiner*—James Beyer
*Attorney, Agent, or Firm*—Klauber & Jackson

[57] ABSTRACT

A self-supporting radiation shield includes a radiation protective sheet; and a skeletal frame for supporting the radiation protective sheet, the skeletal frame including a lower frame member including a semi-elliptical tubular base member mounted on casters and three vertically oriented outer telescoping members extending upwardly therefrom, an upper frame member including a semi-elliptical tubular chest member and three vertically oriented inner telescoping members telescopically received within the outer telescoping members for vertical adjustment therewith, and two arm hooks extending forwardly in an upwardly inclined manner from the free ends of the tubular chest member to permit arms of the user to extend in front of the shield while protecting the front and side portions of the body of the user, and a locking assembly for releasably locking the inner telescoping members at a desired vertical position with respect to the outer telescoping members, the radiation protective sheet being connected to the upper frame member and being wrapped about the upper and lower frame members such that the arcuate upper and lower frame members define a partial enclosure in which the radiation protective sheet protects front and side portions of a user's body from radiation when the user is positioned within the partial enclosure.

21 Claims, 1 Drawing Sheet

PORTABLE RADIATION PROTECTION ENCLOSURE DEVICE

BACKGROUND OF THE INVENTION

The present invention relates to a shield for protecting a person from X-ray radiation. More particularly, the present invention relates to a self-supporting, mobile radiation shield for protecting a health care worker during the performance of a radiological examination.

It is well-known that radiologists, X-ray technicians, dental health care workers and the like, are regularly exposed to X-ray radiation in the work place. In order to protect these individuals from unnecessary exposure to work-related X-ray radiation, the industry has relied on large lead-lined screens or other free-standing partitions, behind which the operator is protected. However, although a free-standing lead partition can provide some degree of mobility to the operator, it is cumbersome and inhibits or prevents the operator from using his arms during examination procedures. An additional disadvantage with a freestanding lead partition is that it offers no side or rear protection.

As an alternative, a lead apron supported by the operator's body, has been relied on to offer protection. However, such lead aprons suffer from the disadvantage that they do not generally protect the operator's arms, shoulders, or head. Additionally, lead aprons offer limited side and rear protection.

A further disadvantage to using a lead apron for protection is that a lead apron can be extremely heavy, and the entire weight thereof is borne by the operator's body. The relatively constant burden and/or continual skeletal loading increases the operator's risk of physical impairment or disability, particularly to the spine.

U.S. Pat. No. 2,494,664 to Lubow discloses an X-ray protective apron which is formed from an integral flexible, rubber or plastic sheeting which is compounded with opaque X-ray protective materials, for example, lead, lead oxide, or the like. The opaque X-ray protective material is covered on both sides with a fabric, and is then fashioned into a front piece which hangs from the user's shoulders. Arm holes are provided through which a wearer's arms pass for placing the burden of carrying the weight on the wearer's shoulders. However, the X-ray protective apron of Lubow suffers from the same disadvantage that the full weight of the apron must be borne by the wearer, and little or no protection is afforded to the wearer's arms, neck and head.

U.S. Pat. No. 3,052,799 to Hollands discloses a radiation protection garment made from a lead-impregnated vinyl, resinous compound or vinyl copolymer plastic material. As with the Lubow apron discussed above, the Hollands garment is designed with the intention of the wearer bearing the entire weight of the protective garment on his body. Additionally, the Hollands garment leaves the wearer's arms, neck and head region unprotected.

U.S. Pat. No. 3,093,829 to Maine and U.S. Pat. No. 4,924,103 to Stein et al. are further examples of X-ray apron constructions which rely on the wearer bearing the entire weight of the apron. The aprons disclosed in these patents further suffer from the disadvantage of less than complete protection for the wearer's extremities, head and neck region, and sides.

U.S. Pat. No. 4,417,146 to Herbert discloses an X-ray attenuating apron which is used in conjunction with two vertical stiffeners for transferring the weight of the apron to another body part, such as the hips. As with the X-ray aprons discussed above, the weight of this apron is still carried by the body of the wearer. Additionally, much of the wearer's body is unprotected from X-ray radiation.

OBJECTS AND SUMMARY OF THE INVENTION

Accordingly, it is an object of the present invention to provide a radiation protection device that does not increase an operator's risk of suffering physical impairment or disability.

It is an another object of the present invention to provide a radiation protection device which provides adequate radiation protection for the operator's front and side body portions.

It is still another object of the present invention to provide a radiation protection device which affords the operator freedom of movement of his arms in front of the device while protecting the remainder of the operator's body.

It is yet another object of the present invention to provide a radiation protection device which may be adjusted for operators of various heights.

It is a further object of the present invention to provide a radiation protection device which allows the operator to work flush against a procedure table during use.

It is still a further object of the present invention to provide a radiation protection device which is extremely stable and which has a self-righting capability from forward tilt, thereby allowing an operator to lean forward during examination procedures.

It is a yet further object of the present invention to provide a radiation protection device which is easily mobile.

It is another object of the present invention to provide a radiation protection device that is relatively easy and economical to use and manufacture.

In accordance with an aspect of the present invention, a self-supporting radiation shield includes a radiation protective sheet; and skeleton frame means for supporting the radiation protective sheet, the skeletal frame means including an upper end having arm hook means for permitting arms of a user to extend in front of the radiation protector sheet while protecting substantially all of front and side portions of the body of the user behind the radiation protector sheet, the skeletal frame means being separate from the user.

In accordance with another aspect of the present invention, a self-supporting radiation shield includes a radiation protective sheet; and skeletal frame means for supporting the radiation protective sheet, the skeletal frame means including a lower frame member, an upper frame member connected with the lower frame member for a vertical adjustment therewith, and locking means for releasably locking the upper frame member to the lower frame member at a desired vertical position, the radiation protective sheet being connected to the upper frame member so as to be wrapped about the upper and lower frame members.

In accordance with still another aspect of the present invention, a self-supporting radiation shield includes a radiation protective sheet; and frame means for supporting the radiation protector sheet, the frame means including effectively arcuate skeletal means, about which the radiation protective sheet is wrapped, for defining a partial enclosure which protects front and side portions of a user's body from radiation when the user is positioned within the partial enclosure and for increasing the stability of the shield.

In accordance with yet another aspect of the present invention, a self-supporting radiation shield includes a radiation protective sheet; and skeletal frame means for supporting the radiation protective sheet, the skeletal frame means including an effectively arcuate lower frame member, an effectively arcuate upper frame member connected with the lower frame member for vertical adjustment therewith, and locking means for releasably locking the upper frame member to the lower frame member at a desired vertical position, the radiation protective sheet being connected to the upper frame member so as to be wrapped about the upper and lower frame members, the effectively arcuate upper and lower frame members defining a partial enclosure such that the radiation protective sheet protects front and side portions of a user's body from radiation when the user is positioned within the partial enclosure, and the upper frame member includes arm hook means for permitting arms of the user to extend in front of the radiation protector sheet while protecting the front and side portions of the body of the user.

The above and other objects, features and advantages of the present invention will become readily apparent from the following detailed description which is to be read in connection with the accompanying drawings.

BRIEF DESCRIPTION OF THE DRAWINGS

For a more complete understanding of the present invention, reference may be had to the following detailed description considered in conjunction with the accompanying drawings, in which.

DETAILED DESCRIPTION OF THE PREFERRED EMBODIMENTS

Figure 1:
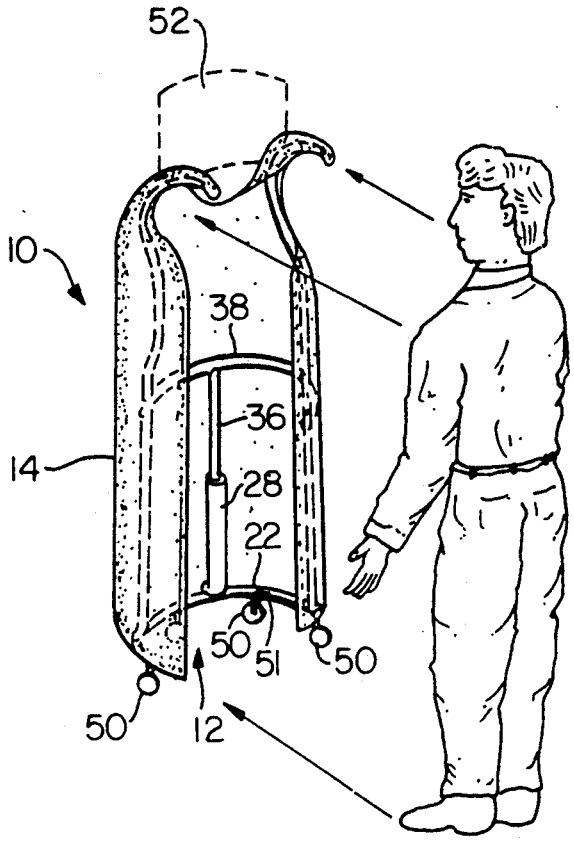
FIG. 1 is a rear perspective view of a radiation protection device according to the present invention.

Referring to the drawings in detail, a self-supporting radiation shield 10 for protecting an operator's torso, lower body, shoulders, sides and extremities from radiation, and particularly X-ray radiation, includes a skeletal frame 12 and a radiation protective sheet 14 connected to skeletal frame 12. Radiation protective sheet 14 preferably includes lead or an equivalent material therein which provides substantial protection against X-ray radiation.

Skeletal frame 12 includes a lower frame member 16, an upper frame member 18 connected with lower frame member 16 for vertical adjustment therewith, and locking means 20 for releasably locking upper frame member 18 to lower frame member 16 at a desired vertical position. As shown best in FIG. 2, lower frame member 16 includes an arcuate base tube 22 having a substantially semi-elliptical configuration along the major axis of the ellipse, and three vertically oriented outer telescoping members 24, 26 and 28 extending upwardly from base tube 22. Preferably, base tube 22 is weighted to provide increased stability and a self-righting capability up to 30° of forward tilt of radiation shield 10.

Figure 2:
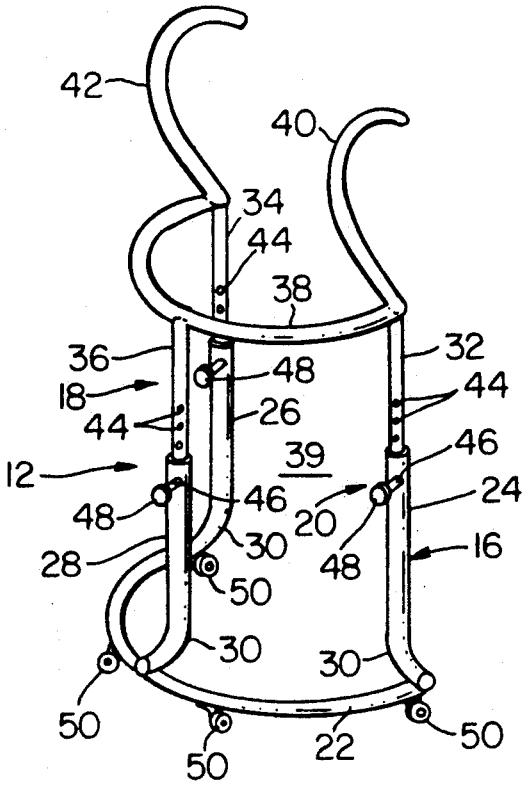
FIG. 2 is a front perspective view of the skeletal frame of the radiation protection device illustrated in FIG. 1.

Outer telescoping members 24 and 26 extend upwardly from opposite ends of base tube 22, while outer telescoping member 28 extends upwardly from base tube 22 at a position substantially mid-way between outer telescoping members 24 and 26. Preferably, as shown in FIG. 2, outer telescoping members 24, 26 and 28 are bent, radially inward with respect to base tube 22, at their lower ends 30 and then extend vertically upward, so that outer telescoping members 24, 26 and 28 have a somewhat L-shaped configuration. Preferably, base tube 22 and outer telescoping members 24, 26 and 28 are made from a tubular stainless steel material. The radially outward curve or bend at lower ends 30 of outer telescoping members 24, 26 and 28 enables base tube 22 to extend over a larger area to provide increased support for radiation shield 10.

Upper frame member 18 includes three vertically oriented inner telescoping members 32, 34 and 36 which are telescopically received within outer telescoping members 24, 26 and 28, respectively, the upper ends of inner telescoping members 32, 34 and 36 being connected with a chest tube 38 having a substantially semi-elliptical configuration along the major axis thereof. It will therefore be appreciated that base tube 22, outer telescoping members 24, 26 and 28, inner telescoping members 32, 34 and 36 and chest tube 38 define a partial enclosure 39 within which the user can position himself, with the lower and upper frame members 16 and 18 extending in front of and around the sides and a portion of the rear of the user.

In accordance with an important aspect of the present invention, arm hook tubes 40 and 42 extend upwardly from opposite free ends of chest tube 38 in a forwardly inclined manner. Therefore, when a user is positioned within partial enclosure 39, the arms of the user can extend within arm hook tubes 40 and 42 in front of radiation shield 10 to permit freedom of arm movement, while protecting the user along the front, sides and a portion of the rear of the user's body.

With the arrangement thus far described, radiation protective sheet 14 is secured, by any suitable means (not shown), such as loops, ties, snaps or the like, to arm hook tubes 40 and 42 and to chest tube 38. As a result, radiation protective sheet extends around the partial enclosure defined by skeletal frame 12 so as to provide full front, side and partial rear shielding, with optional neck/face protection, while permitting freedom of arm movement. This will allow appropriate radiation protection, while minimizing potential impairment or disability due to excessive or continual skeletal loading.

In order to adjust the height of radiation shield 10 for a particular user, locking means 20 includes a plurality of apertures 44 spaced along the lengthwise direction of each inner telescoping member 32, 34 and 36, and a single aperture 46 at the upper end of each outer telescoping member 24, 26 and 28 for selective alignment with any one of the apertures 44 of the respective inner telescoping member. A pin button 48 is positioned within each aperture 46 and selectively positionable within a respective aperture 44 for selectively locking upper frame member 18 at a desired vertical position with respect to lower frame member 16. Alternately, a spring-loaded detent button can be provided in place of pin 48 and, in this regard, the arrangement shown in U.S. Pat. No. 4,616,668 can be used, the entire disclosure of this patent being incorporated herein by reference. In such case, apertures 44 and 46 would be reversed on the parts. Preferably, apertures 44 are spaced at one inch intervals on inner telescoping members 32, 34 and 36. Further, while locking means 20 have shown extending forwardly of the skeletal frame in FIG. 2, they may be positioned on diametrically opposite sides of the inner and outer telescoping members for better access by the user.

In accordance with the present invention, a plurality of, for example four, wheels or ball casters 50 are connected to base tube 22 for supporting the same. Preferably, ball casters 50 are equidistantly spaced from each other. As a result, radiation shield 10 is supported on a floor by ball casters 50 which provide mobility for radiation shield 10. As schematically shown, a self-locking mechanism 51 is provided with each caster 50 for locking the casters 50. Each self-locking mechanism 51 is well-known in the art, and can be actuated by the foot of the operator. In this manner, the operator can tilt radiation shield 10 forward, for example, so that the upper portion thereof is angled over a work table in order for the operator to get close to a patient. Because of the weighting of the base and the arcuate nature of the base, there is a self-righting operation which returns radiation shield 10 to its upright position when the operator leans back.

It is also possible with the present invention to provide a clear neck and face shield 52 to free ends of arm hook tubes 40 and 42, as shown by dashed lines in FIG. 1, neck and face shield 52 having an appropriate lead content to protect the user against X-ray radiation.

It will therefore be appreciated that, with the present invention, there is a reduced potential for physical impairment and disability due to skeletal loading. In addition, there is mobility and freedom of arm movement, thereby allowing examination procedures to be performed, while protecting the user against X-ray radiation. Specifically, there is roughly 270° of radiation protection to the torso, with additional full frontal protection to the shoulders, as well as an option for neck and facial shielding. Also, height adjustment is permitted to allow use by people of various heights. Since radiation protective sheet 14 is connected only with upper frame member 18, vertical adjustability is easily provided, while retaining radiation protective sheet 14 in a substantially wrapped configuration about lower and upper frame members 16 and 18. In addition, because of the weighting of base tube 22, there is a self-righting capability for up to 30° of forward tilt, allowing the user to lean forward during examination procedures. This is also the result of the semi-elliptical configuration thereof. In addition, because of the arrangement of the present invention, there is the capability of the device working flush against a procedure table.

Having described a specific preferred embodiment of the invention with reference to the accompanying drawings, it will be appreciated that the present invention is not limited to that precise embodiment, and that various changes and modifications can be effected therein by one of ordinary skill in the art without departing from the scope or spirit of the invention as defined by the appended claims.

What is claimed is:

1. A self-supporting radiation shield comprising:

a radiation protective sheet; and frame means supporting said radiation protective sheet, said frame means including arcuate skeletal means, about which said radiation protective sheet is wrapped, for defining a partial enclosure which protects front and side portions of a user's body from radiation when the user is positioned within said partial enclosure and for increasing the stability of said shield wherein said frame means includes an arcuate tubular base member, an arcuate tubular chest member and a plurality of vertically oriented tubular connecting members which connect said tubular base member and said tubular chest member in substantially parallel, spaced relation, with said partial enclosure being defined by said arcuate tubular chest and base members as being cylindrical to an extent sufficient to protect substantially all of said front and side portions of the user's body.

2. A self-supporting radiation shield according to claim 1, wherein said tubular base member is weighted to provide a self-righting capability to said radiation shield.

3. A self-supporting radiation shield according to claim 1, wherein said tubular base member and said tubular chest member each have a substantially semi-elliptical configuration along a major elliptical axis thereof.

4. A self-supporting radiation shield according to claim 1, wherein said skeletal frame means further includes arm hook means connected to said tubular chest member for permitting arms of a user to extend in front of said radiation protective sheet while protecting substantially all of front and side portions of the body of the user behind said radiation protective sheet.

5. A self-supporting radiation shield according to claim 4, wherein said arm hook means is forwardly inclined with respect to said skeletal frame means.

6. A self-supporting radiation shield according to claim 4, wherein said arm hook means includes two arm hook tubes having an arcuate configuration for engaging over shoulders of the user.

7. A self-supporting radiation shield according to claim 4, further including neck and face shield means connected to said arm hook means for protecting the neck and face of the user from radiation.

8. A self-supporting radiation shield according to claim 7, wherein said neck and face shield means is transparent.

9. A self-supporting radiation shield according to claim 1, further including rolling means for supporting said radiation shield for rolling movement on a floor, said rolling means being connected with said tubular base member.

10. A self-supporting radiation shield according to claim 9, wherein said rolling means includes a plurality of caster means for supporting said radiation shield for rolling movement on the floor.

11. A self-supporting radiation shield comprising:

a radiation protective sheet; and skeletal frame means for supporting said radiation protective sheet, said skeletal frame means including a lower frame member, an upper frame member connected with said lower frame member for vertical adjustment therewith, and locking means for releasably locking said upper frame member to said lower frame member at a desired vertical position, said radiation protective sheet being connected to said upper frame member so as to be wrapped about the upper and lower frame members to an extent sufficient to protect substantially all of said front and side portions of the user's body, wherein said lower frame member includes an arcuate tubular base member and a plurality of outer telescoping tubes extending upwardly from said tubular base member, and said upper frame member includes an arcuate tubular chest member and a plurality of inner telescoping tubes connected with said arcuate tubular chest member and telescopically received within said outer telescoping tubes of said lower frame member, and said locking means includes means for selectively locking said inner telescoping tubes at a desired telescopic position within said outer telescoping tubes.

12. A self-supporting radiation shield according to claim 11, wherein said tubular base member is weighted to provide a self-righting capability to said radiation shield.

13. A self-supporting radiation shield according to claim 11, wherein said tubular base member and said tubular chest member each have a substantially semi-elliptical configuration along a major elliptical axis thereof.

14. A self-supporting radiation shield according to claim 11, further including arm hook means connected with said upper frame member for permitting arms of a user to extend in front of said radiation protective sheet while protecting substantially all of front and side portions of the body of the user behind said radiation protective sheet.

15. A self-supporting radiation shield according to claim 14, wherein said arm hook means is forwardly inclined with respect to said skeletal frame means.

16. A self-supporting radiation shield according to claim 14, wherein said arm hook means includes two arm hook tubes having an arcuate configuration for engaging over shoulders of the user.

17. A self-supporting radiation shield according to claim 14, further including neck and face shield means connected to said arm hook means for protecting the neck and face of the user from radiation.

18. A self-supporting radiation shield according to claim 14, wherein said neck and face shield means is transparent.

19. A self-supporting radiation shield according to claim 11, further including rolling means for supporting said radiation shield for rolling movement on a floor, said rolling means being connected with said lower frame member.

20. A self-supporting radiation shield according to claim 19, wherein said rolling means includes a plurality of caster means for supporting said radiation shield for rolling movement on the floor.

21. A self-supporting radiation shield comprising:

a radiation protective sheet; and skeletal frame means for supporting said radiation protective sheet, said skeletal frame means including an arcuate lower frame member, an arcuate upper frame member connected with said lower frame member for vertical adjustment therewith, and locking means for releasably locking said upper frame member to said lower frame member at a desired vertical position, said radiation protective sheet being connected to said upper frame member so as to be wrapped about said upper and lower frame members, said arcuate upper and lower frame members defining a cylindrically shaped partial enclosure such that said radiation protective sheet protects substantially all of front and side portions of a user's body from radiation when the user is positioned within said cylindrically shaped partial enclosure, and said upper frame member includes arm hook means for permitting arms of the user to extend in front of said radiation protective sheet while protecting the front and side portions of the body of the user.

* * * * *